US010196815B2

(12) United States Patent
Dickson

(10) Patent No.: US 10,196,815 B2
(45) Date of Patent: Feb. 5, 2019

(54) WALL PARTITION MOVEMENT SYSTEMS AND METHODS

(71) Applicant: Advanced Equipment Corporation, Fullerton, CA (US)

(72) Inventor: Scott Dickson, Brea, CA (US)

(73) Assignee: Advanced Equipment Corporation, Fullerton, CA (US)

( * ) Notice: Subject to any disclaimer, the term of this patent is extended or adjusted under 35 U.S.C. 154(b) by 273 days.

(21) Appl. No.: 15/148,992

(22) Filed: May 6, 2016

(65) Prior Publication Data

US 2016/0251852 A1 Sep. 1, 2016

Related U.S. Application Data

(63) Continuation-in-part of application No. 14/289,482, filed on May 28, 2014, now Pat. No. 9,359,804.

(51) Int. Cl.

| | |
|---|---|
| ***E05D 15/06*** | (2006.01) |
| ***E04B 2/88*** | (2006.01) |
| ***E05F 15/70*** | (2015.01) |
| ***E05F 15/632*** | (2015.01) |
| ***E04B 2/82*** | (2006.01) |
| ***E05F 15/60*** | (2015.01) |
| *E05F 15/41* | (2015.01) |
| *E05F 15/641* | (2015.01) |
| *E05F 15/646* | (2015.01) |
| *E05F 15/638* | (2015.01) |

(52) U.S. Cl.

CPC ..... *E04B 2/88* (2013.01); *E04B 2/827* (2013.01); *E05D 15/063* (2013.01); *E05F 15/60* (2015.01); *E05F 15/632* (2015.01); *E05F 15/70* (2015.01); *E05F 15/41* (2015.01); *E05F 15/638* (2015.01); *E05F 15/641* (2015.01); *E05F 15/646* (2015.01); *E05Y 2400/415* (2013.01); *E05Y 2600/13* (2013.01); *E05Y 2900/142* (2013.01)

(58) Field of Classification Search

CPC ..... E05F 15/60; E05F 15/70; E05F 15/632; E05F 15/635; E05F 15/638; E05F 15/641; E05F 15/646; E05F 15/41; E04B 2/88; E04B 2/827

See application file for complete search history.

(56) References Cited

U.S. PATENT DOCUMENTS

| | | | | |
|---|---|---|---|---|
| 3,071,825 | A * | 1/1963 | Ferris | B65G 9/002 104/105 |
| 3,279,123 | A | 10/1966 | Genison | |
| 3,334,375 | A * | 8/1967 | Eugene | E05D 15/0608 16/100 |
| 3,570,577 | A | 3/1971 | Bedrin et al. | |
| 3,577,679 | A | 5/1971 | Petterborg | |
| 3,720,254 | A | 3/1973 | Smart | |
| 4,642,947 | A | 2/1987 | Dickson | |
| 4,957,600 | A | 9/1990 | Carlson et al. | |

(Continued)

*Primary Examiner* — Katherine W Mitchell
*Assistant Examiner* — Abe Massad
(74) *Attorney, Agent, or Firm* — Barry IP Law, P.C.

(57) ABSTRACT

At least one panel including a trolley is fed to a first drive mechanism of a plurality of drive mechanisms adjacent a main track configured to engage the trolley of the at least one panel. The first drive mechanism is initiated to drive the at least one panel to a second drive mechanism of the plurality of drive mechanisms to move the at least one panel farther along the main track.

23 Claims, 9 Drawing Sheets

(56) References Cited

U.S. PATENT DOCUMENTS

| | | | | |
|---|---|---|---|---|
| 4,998,577 | A | 3/1991 | Kobayashi et al. | |
| 5,022,454 | A | 6/1991 | Kobayashi et al. | |
| 5,230,123 | A | 7/1993 | Williams et al. | |
| RE34,360 | E | 8/1993 | Carlson et al. | |
| 5,357,651 | A | 10/1994 | Jones et al. | |
| 6,082,053 | A | 7/2000 | Bischof et al. | |
| 6,134,836 | A * | 10/2000 | Kawanobe ..... | E05F 15/646 340/12.22 |
| 6,233,878 | B1 | 5/2001 | Krahenbuhl et al. | |
| 6,352,097 | B1 | 3/2002 | Kern et al. | |
| 6,360,487 | B1 | 3/2002 | Kern et al. | |
| 6,923,238 | B2 | 8/2005 | Kern et al. | |
| 7,228,664 | B2 | 6/2007 | Clark | |
| 7,296,608 | B2 | 11/2007 | Weishar et al. | |
| 7,757,437 | B2 | 7/2010 | Schulte et al. | |
| 8,307,877 | B1 | 11/2012 | Lambridis et al. | |
| 8,424,244 | B2 | 4/2013 | Tarrega Lloret | |
| 8,534,341 | B2 | 9/2013 | Coleman et al. | |
| 8,671,633 | B2 | 3/2014 | Haab et al. | |
| 2006/0144529 | A1 | 7/2006 | Hemphill | |
| 2008/0163553 | A1 * | 7/2008 | Liao ..... | E05F 11/423 49/362 |
| 2011/0138692 | A1 | 6/2011 | Lemstra | |
| 2012/0325413 | A1 | 12/2012 | Smart et al. | |
| 2014/0013685 | A1 | 1/2014 | Coleman et al. | |

* cited by examiner

WALL PARTITION MOVEMENT SYSTEMS AND METHODS

CROSS-REFERENCE TO RELATED APPLICATION

The present application is a continuation-in-part of U.S. patent application Ser. No. 14/289,482, filed on May 28, 2014, which is hereby incorporated by reference in its entirety.

FIELD

The present disclosure relates to partitioning a room. More particularly, the present disclosure relates to the movement of wall panels for partitioning a room.

BACKGROUND

Partitions are often used to divide large rooms such as theaters, conference rooms, convention halls or gymnasiums. Typical partitions can include panels that hang from an overhead track and slide or unfold horizontally along the track from a storage position to partition a room. Such partitions often require a team of many people along the track to physically move panels along the track and can take a relatively long time to move and secure all of the panels into their final positions in the partition. A similar process is often performed when moving the panel from their position in the partition back to their storage position.

In addition to requiring more people or time to move panels into place, conventional partition movement systems are also more likely to be subjected to abuse due to manual movement of the panels. Conventional partition movement systems where panels are affixed to a cable driven along a track may not require as many people or as much time to move panels into place, but such systems generally do not allow for variations in the paths the panels may take since the panels must follow a fixed cable path.

BRIEF DESCRIPTION OF THE DRAWINGS

The features and advantages of the embodiments of the present disclosure will become more apparent from the detailed description set forth below when taken in conjunction with the drawings. The drawings and the associated descriptions are provided to illustrate embodiments of the disclosure and not to limit the scope of what is claimed.

DETAILED DESCRIPTION

In the following detailed description, numerous specific details are set forth to provide a full understanding of the present disclosure. It will be apparent, however, to one of ordinary skill in the art that the various embodiments disclosed may be practiced without some of these specific details. In other instances, well-known structures and techniques have not been shown in detail to avoid unnecessarily obscuring the various embodiments.

Figure 1:
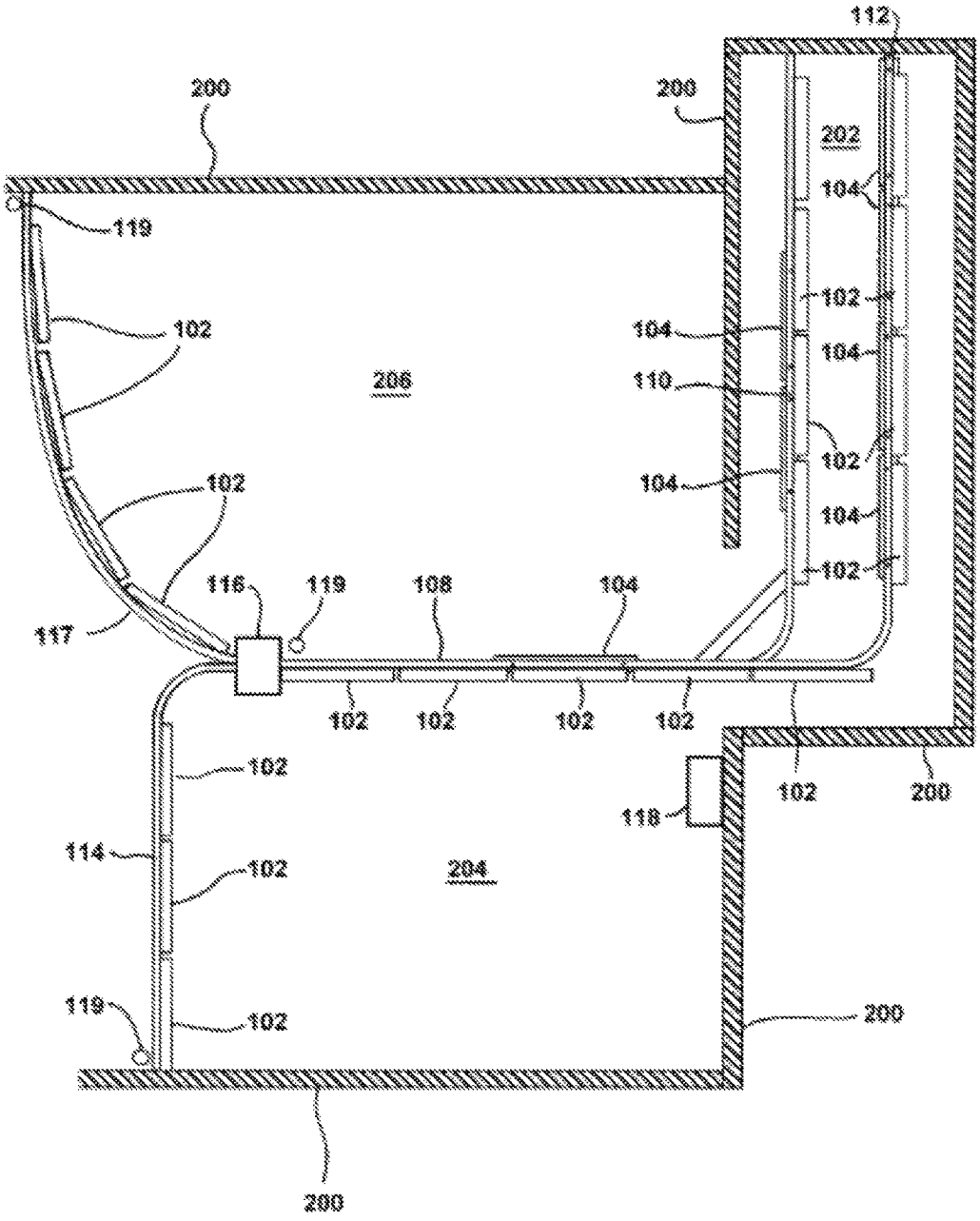
FIG. 1 depicts an overview of a wall partition movement system according to an embodiment.

FIG. 1 depicts an overview of a wall partition movement system according to an embodiment. As shown in FIG. 1, wall partition movement system 100 includes a plurality of drive mechanisms 102 adjacent main track 108, auxiliary tracks 114 and 117, and storage tracks 110 and 112. Each of the plurality of drive mechanisms 102 are configured to drive panels along the track by driving the panels from one drive mechanism 102 to the next drive mechanism 102. In the example of FIG. 1, drive mechanisms 102, main track 108, auxiliary tracks 114 and 117, and storage tracks 110 and 112 are positioned above the panels.

When not in use, panels 104 are stored in storage area 202 and suspended from storage tracks 110 and 112. In particular, panels 104 are suspended from storage track 110 and storage track 112. When needed to form a wall partition, panels 104 are driven out of storage area 202 using drive mechanisms 102 adjacent storage tracks 110 and 112. In some implementations, an operator may pull panels 104 out from storage area 202 as they slide along main track 108 and feed the panels to a first drive mechanism 102 just outside of storage area 202 adjacent main track 108.

As discussed in more detail below, panels 104 include a trolley that engages main track 108. The trolley may include one or more wheels that allow the panels to travel along the tracks. At least one wheel of the trolley includes a flange that is used to direct the panel along one of storage track 110 or storage track 112. In the example of FIG. 1, the panels stored on storage track 110 include a flanged wheel on one side of the trolley while the panels stored on storage track 112 include a flanged wheel on the opposite side of the trolley to allow the panels to be directed along one of storage track 110 or storage track 112 due to a corresponding mating flange on the same side of the storage track.

In operation, controller 118 can initiate drive mechanisms 102 along storage track 110 to begin feeding panels 104 from storage area 202 onto main track 108. The sequencing of turning drive mechanisms 102 on and off can be based on a predetermined timing or based on an input from an operator of controller 118. In addition, controller 118 can also sequence drive mechanisms 102 along main track 108 and auxiliary tracks 114 and 117 to turn certain drive mechanisms 102 on or off.

Controller 118 can include a Programmable Logic Controller (PLC) or a microprocessor controller that executes computer readable instructions stored in a memory of controller 118 to control operation of drive mechanisms 102. Sensors 119 are electrically connected to controller 118 to provide an indication of a location of a panel along main track 108 or auxiliary tracks 114 and 117. Sensors 119 can include a proximity sensor, such as an electromagnetic or inductive sensor. In other implementations, sensors 119 can include a contact sensor or switch.

In one embodiment, a particular panel can include a sensed element that is detected by sensor 119 so as to indicate to controller 118 when the panel has reached a certain location along tracks 114, 117, or 108. In another embodiment, sensor 119 provides controller 118 with a signal for each panel that passes a certain location along tracks 108, 114 or 117. Controller 118 can then use this location information to turn particular drive mechanisms on or off or to control a speed of a drive mechanism 102.

In this regard, controller 118 may also allow for the drive mechanisms to drive the panels at different speeds through the use of, for example, a Variable Frequency Drive (VFD) connected to the drive mechanisms 102. A variable speed drive for drive mechanisms 102 can be used when starting or stopping wall partition movement system 100 to provide a smooth start or stop to movement of the panels. In other embodiments, each drive mechanism 102 or particular drive mechanisms 102 such as those at the beginning or end of a track may be equipped with a variable speed drive to slow down or speed up the panels as they approach a turn or reach the end of a track.

The panels are driven along main track 108 from one drive mechanism 102 to the next to move the panels toward positions for forming a wall partition to define room 204 or 206 with building walls 200. An operator or controller 118 may also lock the panels into place to complete the assembled wall partition. In addition, the operator or controller 118 can engage a seal along the top, bottom, or side of one or more panels to reduce sound from traveling from one side of the assembled wall partition to the other side.

Controller 118 is electrically connected to track guide 116 and can actuate track guide 116 to switch between connecting main track 108 to one of auxiliary track 114 or auxiliary track 117 positioned at an angle to main track 108. After switching the direction of travel from main track 108 toward an auxiliary track, a drive mechanism 102 adjacent the auxiliary track is initiated to drive a panel away from main track 108 and toward or onto the auxiliary track. When moving the panels back to storage area 202, the drive mechanism 102 drives the panel the opposite direction from the auxiliary track toward main track 108. The drive mechanisms adjacent main track 108 are then used to drive the panels back toward storage area 202.

As shown in FIG. 1, drive mechanisms 102 can drive panels through relatively tight turns in the track such as from main track 108 and auxiliary track 114, as well as through relatively wide radius turns such as from main track 108 and auxiliary track 117. Conventional wall partition movement systems such as those which have panels affixed to cables generally cannot accommodate such wide radius turns.

As appreciated by those of ordinary skill in the art, wall partition movement system 100 in other embodiments can include more or less tracks, panels and drive mechanisms than those shown in FIG. 1.

Figure 2:
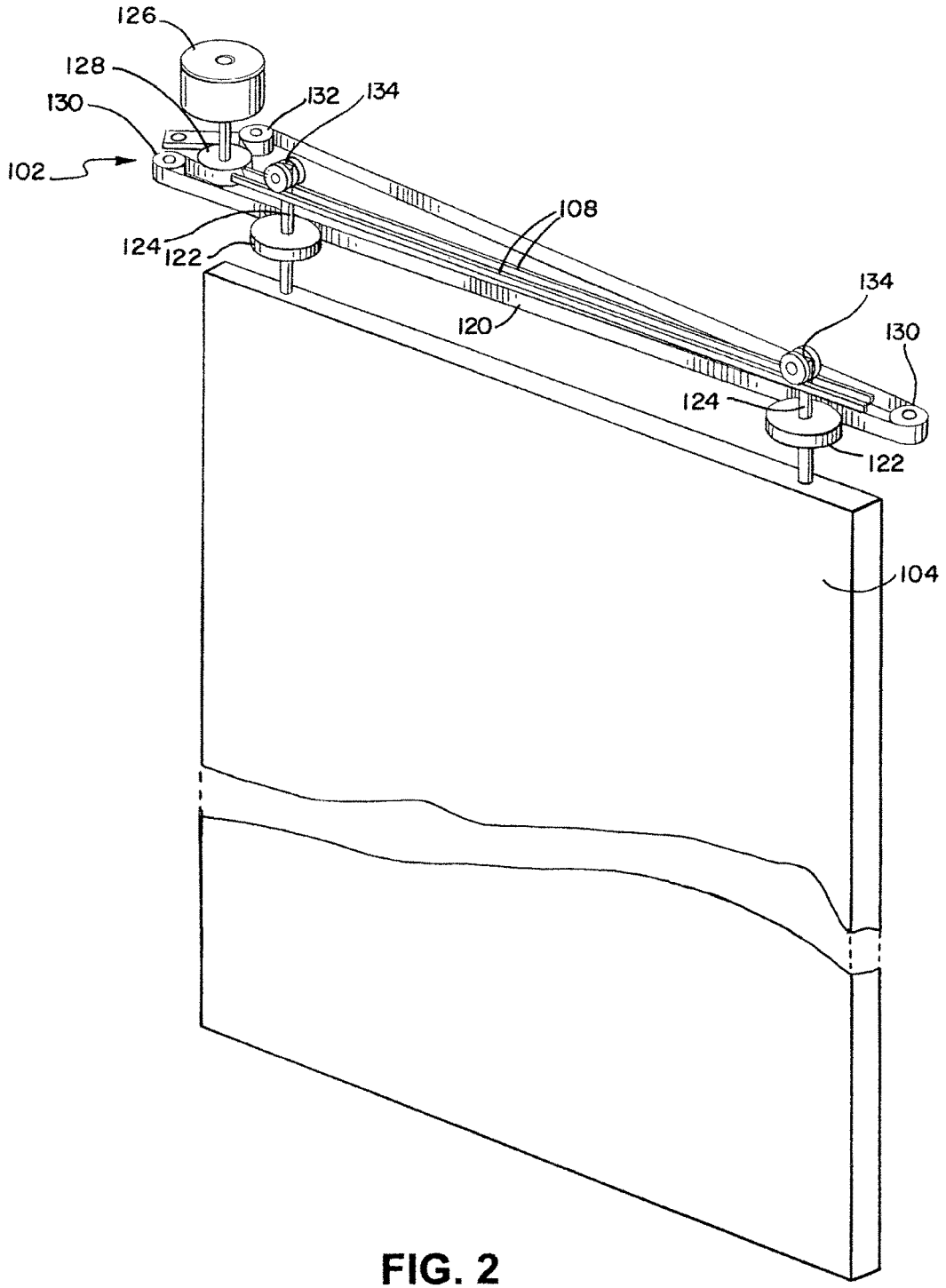
FIG. 2 is an isometric view of a panel driven by a drive mechanism including a friction belt according to an embodiment.

FIG. 2 provides a perspective view of a drive mechanism 102 and a panel according to an embodiment. As shown in FIG. 2, panel 104 includes two suspension rods 124 for supporting the weight of panel 104 from main track 108. In one implementation, suspension rods 124 can include pendant bolts affixed to panel 104 approximately along a centerline along a width of panel 104. Panel 104 also includes a trolley 134 connected to each suspension rod 124 to engage main track 108 to allow panel 104 to move along main track 108. Other embodiments can include more or less suspension rods and trolleys based on the size and weight of panel 104. In this regard, panel 104 in some embodiments can weigh several hundred pounds with each panel extending over five feet in length. However, those of ordinary skill in the art will appreciate that the present disclosure is not limited to a particular sized panel.

Drivable element 122 is also connected to suspension rods 124 and is positioned to contact looped element 120 of drive mechanism 102. In the embodiment of FIG. 2, looped element 120 of drive mechanism 102 can include a friction belt, timing belt, or a chain. In an implementation where looped element 120 includes a friction belt or a timing belt, drivable element 122 of panel 104 can include a deformable wheel made of a material such as rubber. In an implementation where looped element 120 includes a timing belt, drivable element 122 also includes teeth that engage with teeth on looped element 120. The number, material and shape of drivable elements 122 can vary based on specific design criteria for wall partition movement system 100, such as the weight and size of panel 104 or a speed of looped element 120.

In foregoing implementations including a friction belt or a timing belt, drivable element 122 can be configured to deform or compress as shown in FIG. 2 when panel 104 is driven by drive mechanism 102 through frictional force between drivable element 122 and the friction belt or timing belt. The material and shape of drivable element 122 can be such that it does not slip when in contact with the friction belt or timing belt. In addition, some implementations using a timing belt for looped element 120 may allow drivable element 122 to pivot or rotate within a few degrees in order to synchronize the engagement of teeth of drivable element 122 with the teeth of the timing belt.

In an implementation where looped element 120 includes a chain, drivable element 122 can include a sprocket configured to engage the chain. Drivable element 122 may be allowed to pivot or rotate within a few degrees in order to synchronize the meshing of teeth of drivable element 122 with the chain.

Drive mechanism 102 includes motor 126 configured to drive looped element 120 around roller 130 using drive wheel 128. Drive mechanism 102 and main track 108 can be mounted above a building ceiling so as to generally conceal drive mechanism 102 and main track 108 from view.

In some embodiments, motor 126 may include a magnetic starter to allow for motor 126 to start after rotation of drive wheel 128 to allow for the automatic starting of drive mechanism 102 after being fed a panel. In addition, motor 126 may also include a clutch that disengages stops motor 126 from driving drive wheel 128 after encountering a resistance rotation of drive wheel 128. In other implementations, motor 126 may stop on its own after encountering a resistance to rotation of drive wheel 128. Such resistance to rotation may be detected from a current used by motor 126 exceeding a current limit. In such an implementation, drive mechanism 102 can automatically stop when a panel driven by drive mechanism 102 reaches a final position when a next panel along the track prevents movement of the panel along the track. In addition, such an automatic stop can also serve as a safety feature to cause the panel to automatically stop when encountering an obstacle along its path.

The clutches or stopping of motors 126 can also be controlled by controller 118 so that controller 118 can sequence the motors 126 off as discussed above or can stop movement of the panels through an override switch or an input received from an operator at controller 118.

Figure 3:
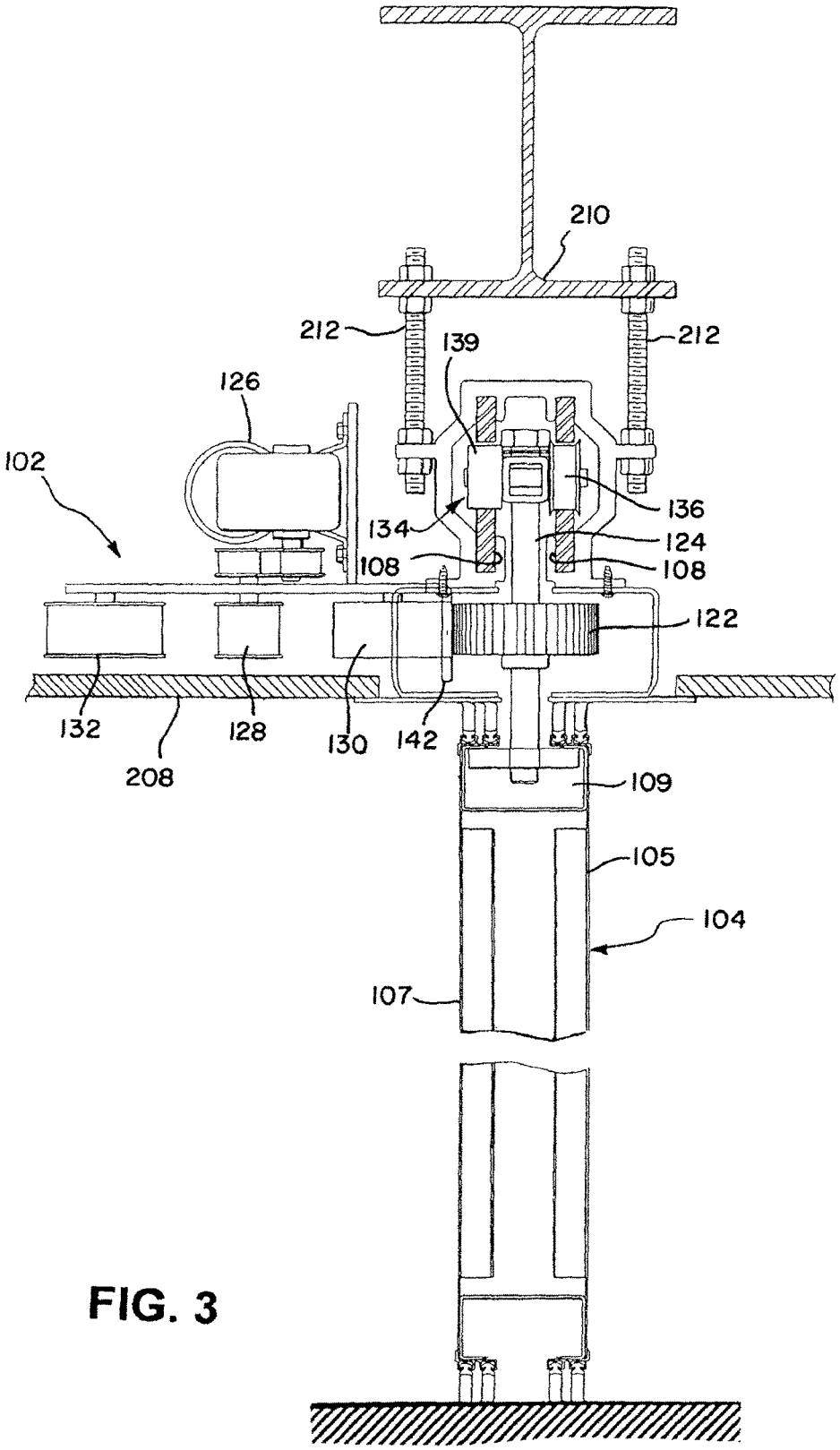
FIG. 3 is a cross section view of the panel and drive mechanism of FIG. 2.

FIG. 3 provides a cross section view of panel 104 and drive mechanism 102 according to an embodiment. In the example of FIG. 3, panel 104 is hollow between outer walls 105 and 107 of panel 104 to provide for a reduced weight of panel 104. In addition, panel 104 can be designed to provide rigidity and acoustic soundproofing qualities while having an interior cavity to reduce weight of panel 104. In other embodiments, the construction of panel 104 can differ such as, for example, including a solid construction of panel 104 without an interior cavity.

Suspension rod 124 is attached to panel 104 at header 109 on one end portion and attached to trolley 134 on the opposite end portion of suspension rod 124. Trolley 134 includes wheel 139 and flanged wheel 136. Main track 108 engages wheel 139 and flanged wheel 136 as shown in FIG. 3 to allow panel 104 to travel along main track 108. In addition, main track 108 is suspended by rods 212 from building support 210. As appreciated by those of ordinary skill in the art, the construction of track 108 can differ in other embodiments such as by engaging with trolley 134 with a different configuration of track 108.

Drivable element 122 is affixed on suspension rod 124 so as to contact looped element 120 (not shown in FIG. 3) of drive mechanism 102. In an implementation where looped element 120 includes a friction belt or a timing belt, drive mechanism 102 can include belt guide 142 which provides a surface against which the belt moves to ensure contact between the belt and drivable element 122. In some implementations, belt guide 142 and looped element 120 can be approximately 1 to 2 inches in height. The height of looped element 120 and belt guide 142 can vary based on design considerations such as a weight of the panels or the torque of motor 126. In an implementation where looped element 120 includes a chain, belt guide 142 can be omitted.

Figure 4:
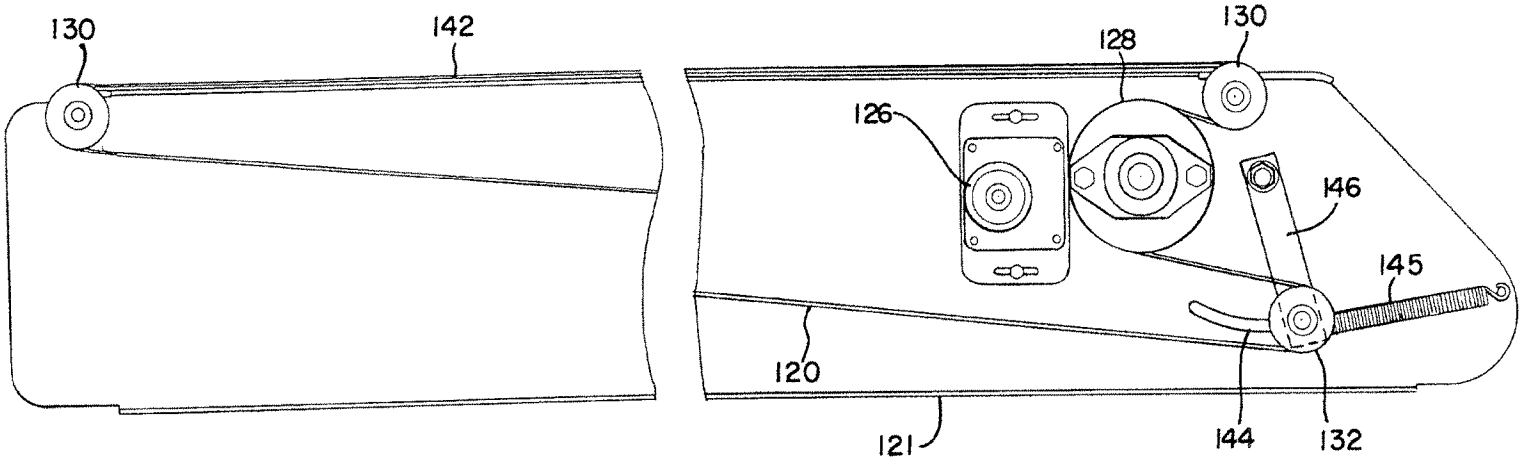
FIG. 4 is a top view of the drive mechanism of FIG. 3.

FIG. 4 provides a top view of drive mechanism 102 according to an embodiment. As shown in FIG. 4, the components of drive mechanism 102 are mounted on frame 121. Motor 126 of drive mechanism 102 rotates drive wheel 128 to drive looped element 120 around rollers 130 and tension roller 132. Drive wheel 128 also drives looped element 120 along belt guide 142.

Tension roller 132 can be used to facilitate removal of looped element 120 for replacement or maintenance. Tension roller 132 is mounted on tension arm 146 and is moved along slot 144 against the resistance of spring 145 when removing looped element 120 to loosen looped element 120. In other embodiments, a gas cylinder or other mechanism for maintaining tension of looped element 120 can be used instead of spring 145. In yet other embodiments, tension roller 132, slot 144, spring 145, and tension arm 146 can be omitted.

Figure 5:
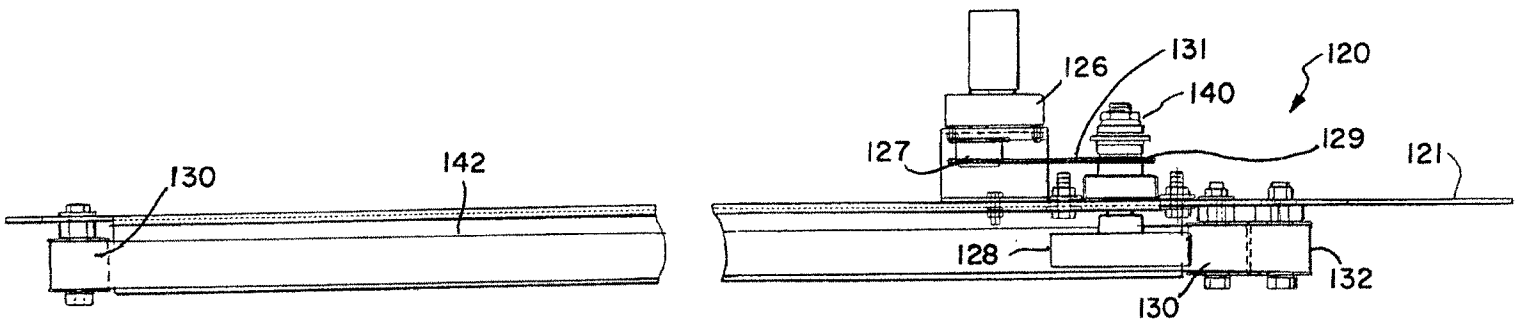
FIG. 5 is a side view of the drive mechanism of FIG. 4.

The embodiment of FIGS. 3 to 5 also allows for replacement, repair or adjustment of other components, such as drivable element 122, which may become worn after significant use. For example, after drivable element 122 becomes worn or as part of a routine maintenance operation, drivable element 122 can be repositioned or turned about suspension rod 124 so that a different outer portion of drivable element 122 contacts looped element 120. In this way, it is ordinarily possible to prolong the usable life of drivable element 122.

FIG. 5 provides a side view of drive mechanism 102 according to an embodiment. As shown in FIG. 5, drive mechanism 102 also includes torque limiter 140 to protect looped element 120 from over-tensioning. In other embodiments, torque limiter 140 can be replaced with an electric clutch that can disengage motor 126 when a current limit is exceeded so as to protect looped element 120 from over-tensioning. Motor 126 can be sized based on various design considerations such as power supply or a weight of panels in wall partition movement system 100. In one implementation, motor 126 can provide a torque of approximately 50 inch-pounds and rotate at a speed of approximately 50 revolutions per minute. The specifications of motor 126 can vary in other implementations.

In FIGS. 4 and 5, motor 126 and drive wheel 128 are positioned adjacent each other so that motor 126 can drive drive wheel 128 via chain 131 and sprockets 127 and 129. In other embodiments, other drive configurations may be used such as a direct drive configuration with motor 126 positioned above drive wheel 128 without chain 131 and sprockets 127 and 129.

Figure 6:
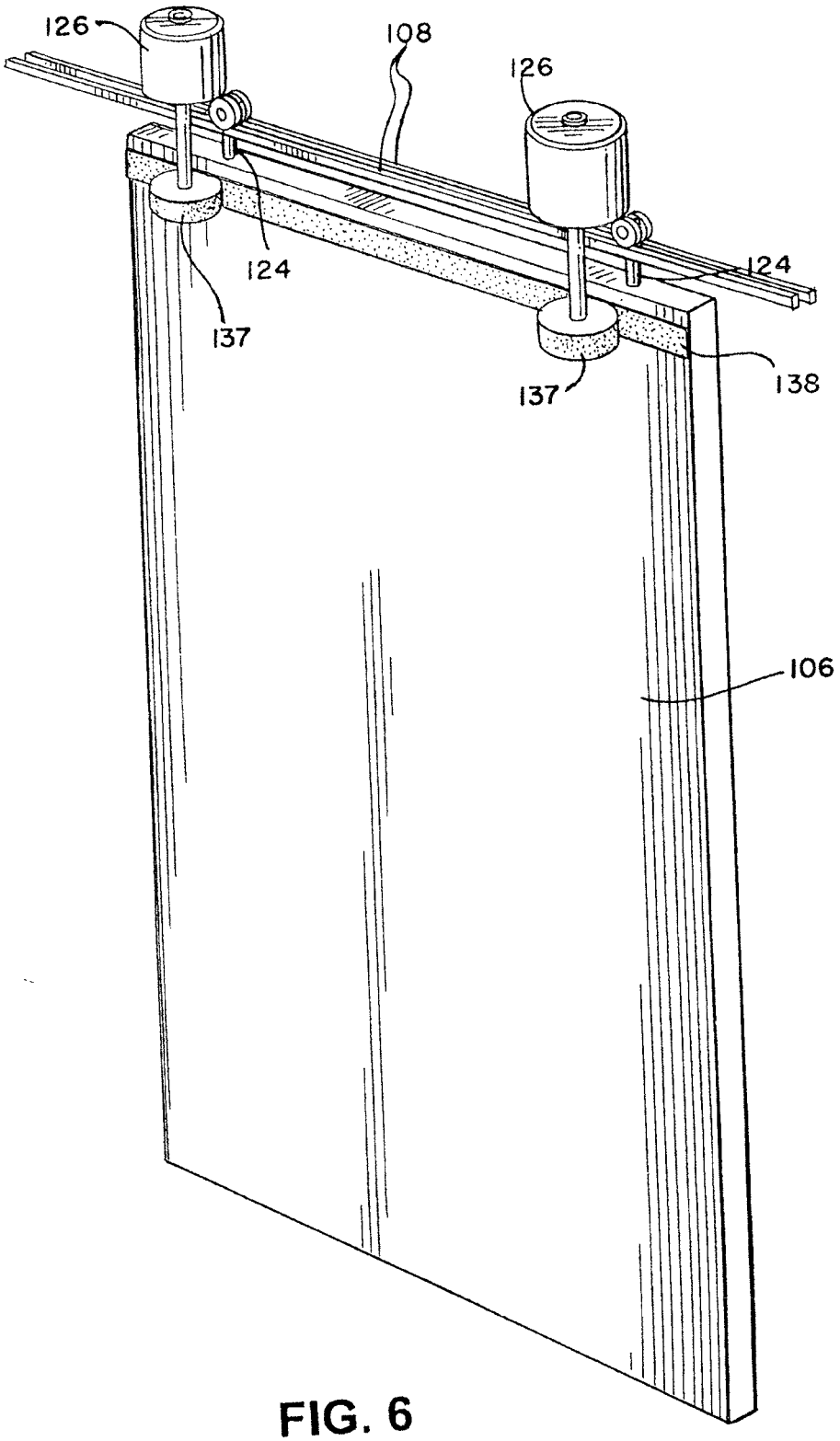
FIG. 6 is an isometric view of a panel including a friction strip and a drive mechanism including a contact wheel according to an embodiment.

FIG. 6 provides a perspective view of an embodiment of drive mechanism 103 and panel 106. As shown in FIG. 6, drive mechanism 103 includes two motors 126 each driving a contact wheel 137 for driving drivable element 138 of panel 106. In the example of FIG. 6, drivable element 138 is a friction strip mounted on panel 106. The friction strip can be mounted along an entire width of panel 106 or along a portion of panel 106.

In one implementation, contact wheels 137 can include a deformable material such as a rubber wheel that can compress against drivable element 138 and impart a frictional force on drivable element 138 to move panel 106 along main track 108.

In another implementation, contact wheels 137 can include a non-deformable material and drivable element 138 can include a deformable material such as rubber that can compress against contact wheels 137.

The embodiment of FIG. 6 can be particularly well suited for retrofit applications where panels are already engaged with main track 108 since the panels only need to be modified by mounting friction strips on the panels. Alternatively, the embodiment of FIG. 6 can be used for a new installation rather than a retrofit application. As with the embodiment of FIGS. 3 to 5, components such as contact wheel 137 and drivable element 138 can be replaced and maintained as needed due to wear.

Figure 7:
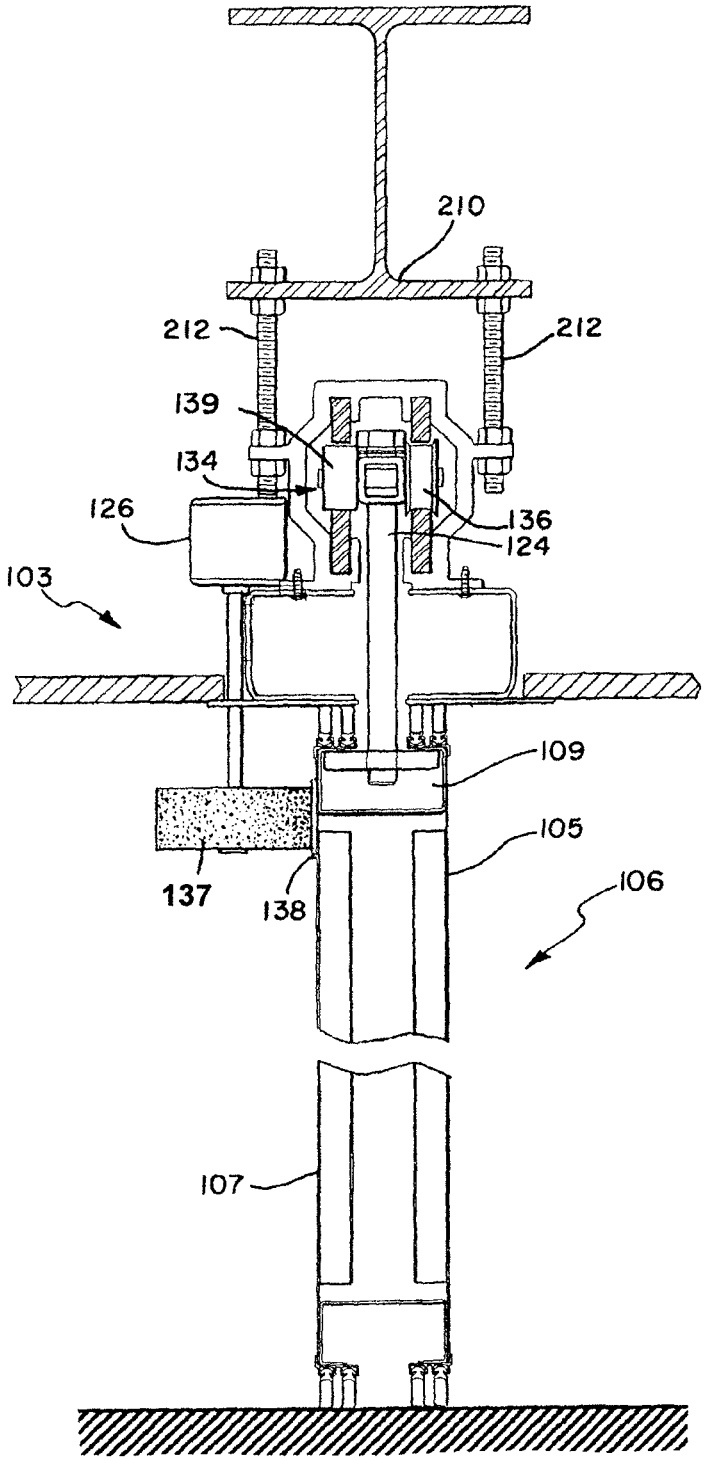
FIG. 7 is a cross section of the panel and drive mechanism of FIG. 6.

FIG. 7 provides a cross section view of panel 106 and drive mechanism 103 according to an embodiment. As shown in FIG. 7, motor 126 drives contact wheel 137, which contacts drivable element 138 to drive panel 106 along the track.

Figure 8:
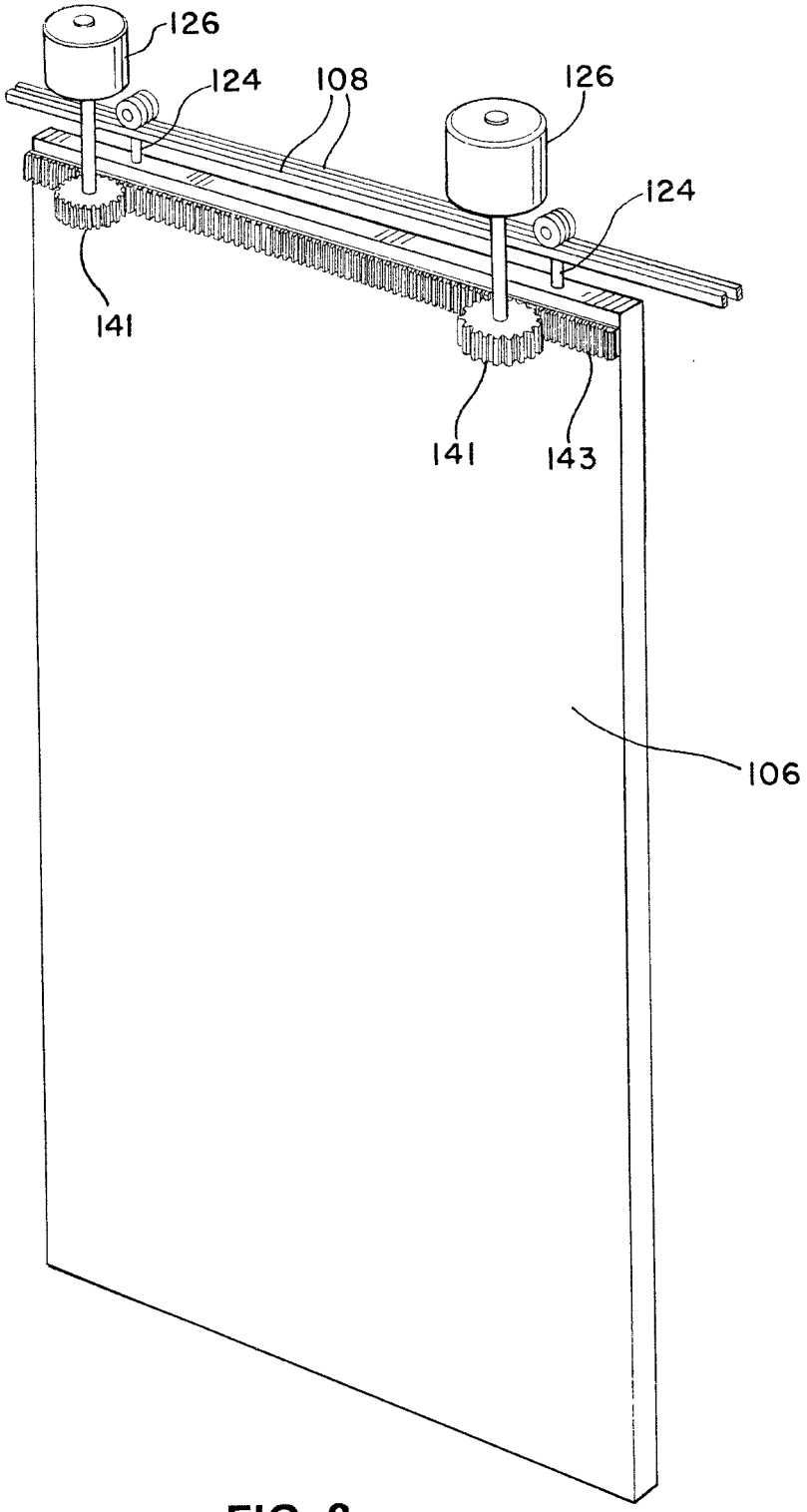
FIG. 8 is an isometric view of a panel including a strip with teeth and a drive mechanism including a contact wheel according to an embodiment.

FIG. 8 provides a perspective view of an embodiment of drive mechanism 103 and panel 106 where drivable element 143 is a strip mounted on panel 106 with teeth similar to a timing belt. As shown in FIG. 8, drive mechanism 103 includes two motors 126 each driving a contact wheel 141 for driving drivable element 143 of panel 106. The teeth of drivable element 143 are configured to engage with the teeth of the contact wheels 141 to drive panel 106. Drivable element 143 can be mounted along an entire width of panel 106 or along a portion of panel 106.

In some implementations, motors 126 may allow contact wheels 141 to pivot or rotate within a few degrees in order to synchronize the engagement of teeth of drivable element 143 with the teeth of contact wheels 141. In one implementation, contact wheels 141 can also include a deformable material such as a rubber wheel that can compress against drivable element 143 and further improve the engagement between the teeth of drivable element 143 and contact wheels 141.

In another implementation, contact wheels 141 can include a non-deformable material and drivable element 143 can include a deformable material such as rubber that can compress against contact wheels 141.

As with the friction strip example of FIGS. 6 and 7, the example shown in FIG. 8 can be particularly well suited for retrofit applications where panels are already engaged with main track 108 since the panels only need to be modified by mounting timing or toothed strips on the panels. Alternatively, the embodiment of FIG. 8 can be used for a new installation rather than a retrofit application. As with the embodiment of FIGS. 3 to 5, components such as contact wheel 141 and drivable element 143 can be replaced and maintained as needed due to wear.

Figure 9:
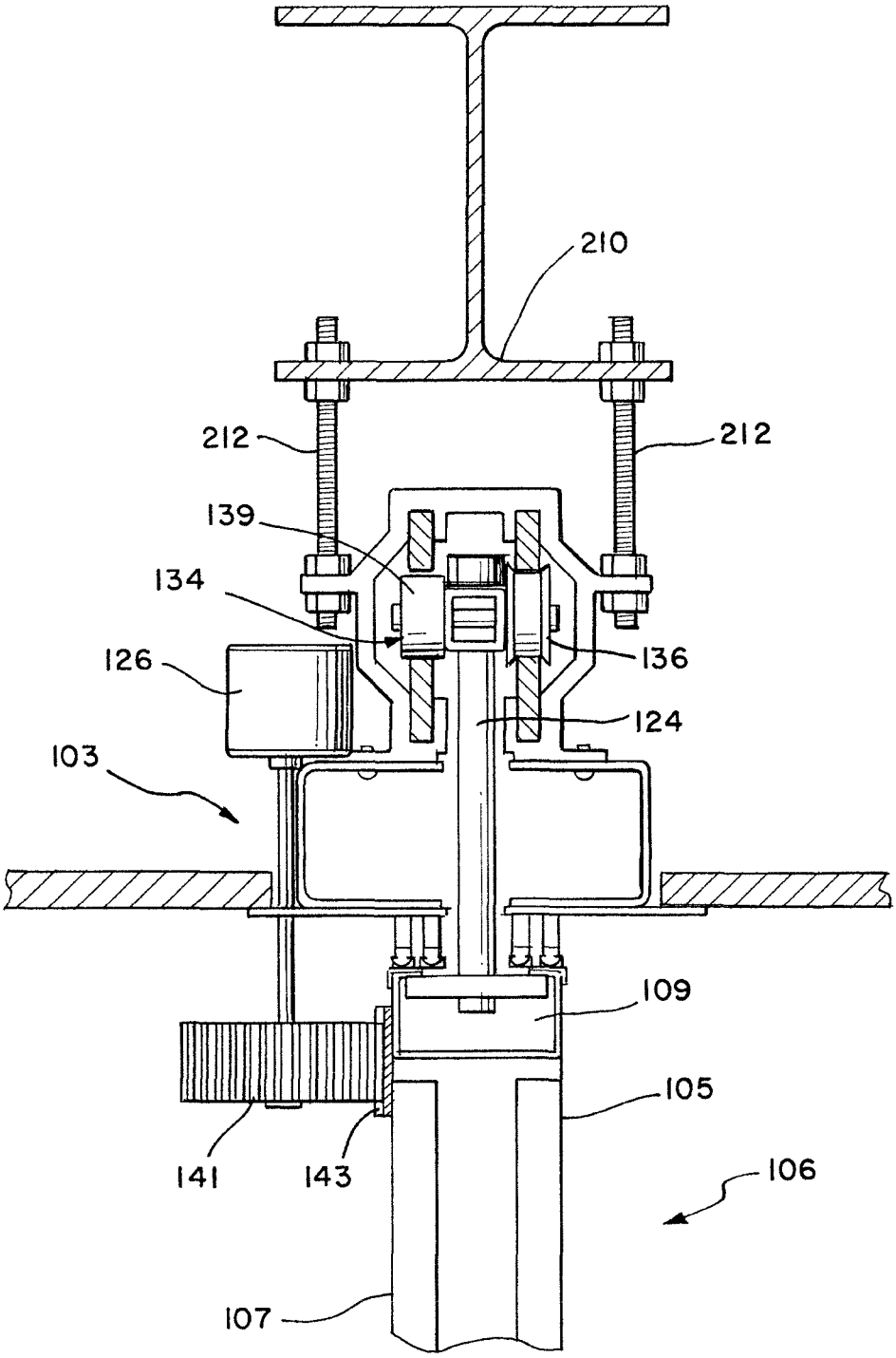
FIG. 9 is a cross section of the panel and drive mechanism of FIG. 8.

FIG. 9 provides a cross section view of panel 106 and drive mechanism 103 including contact wheels 141 and drivable element 143. As shown in FIG. 9, motor 126 drives contact wheel 141, which contacts drivable element 143 to drive panel 106 along the track.

Figure 10:
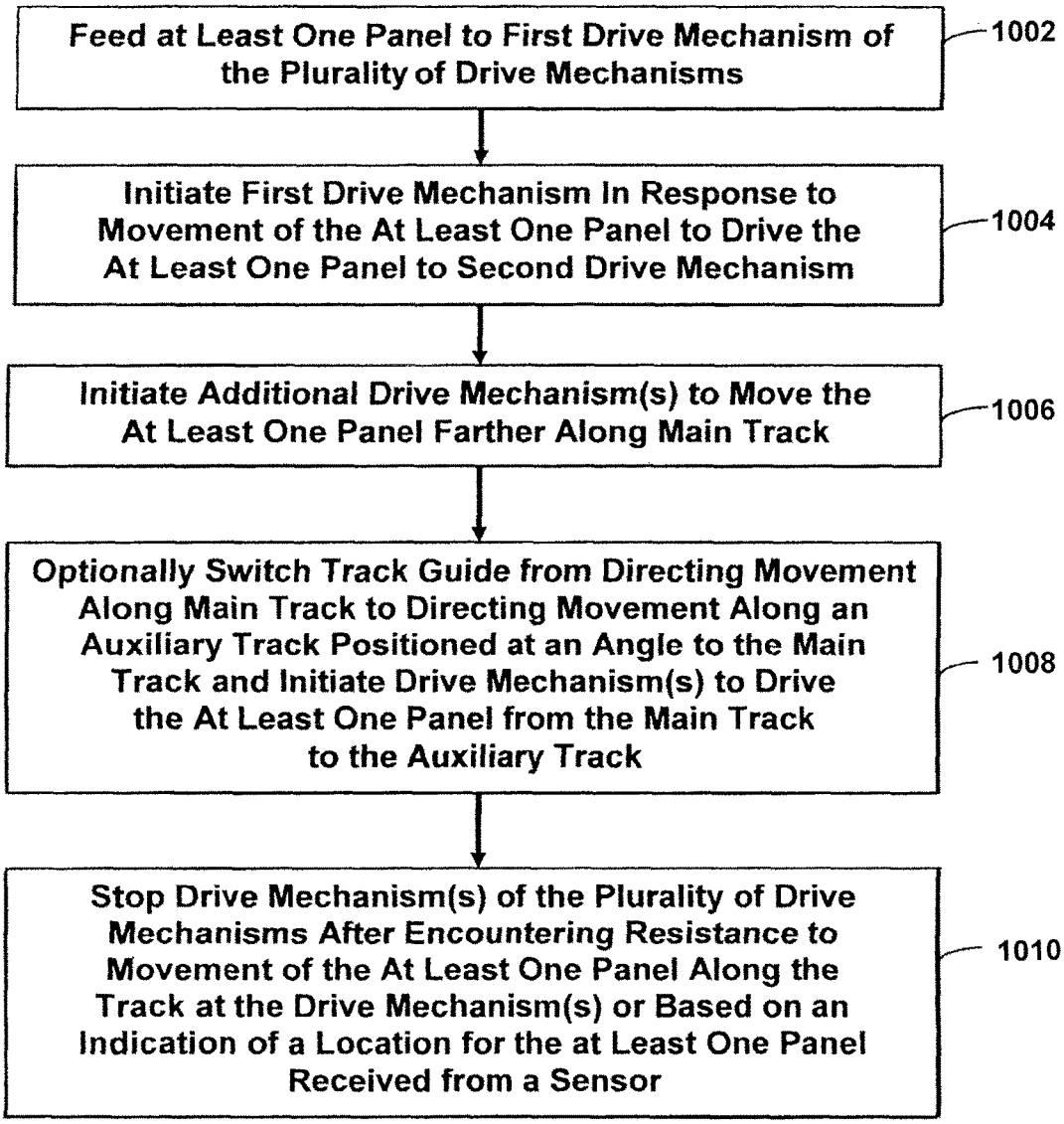
FIG. 10 is a flowchart for a wall panel movement process according to an embodiment.

FIG. 10 is a flowchart for a wall partition movement process according to an embodiment. The process of FIG. 10 begins with block 1002 where at least one panel is fed to a first drive mechanism 102. This can be performed by an operator outside of storage area 202, for example, or can be performed by initiating a drive mechanism 102 to feed the at least one panel to the first drive mechanism 102.

In block 1104, the first drive mechanism 102 is initiated in response to movement of the at least one panel to drive the at least one panel to a second drive mechanism 102. In some implementations, drive mechanisms 102 are configured to start driving a panel in response to movement of the panel along the track. In one such example, motor 126 includes a magnetic starter such that rotation of drive wheel 128 or contact wheel 137 starts motor 126. In other examples, the starting of drive mechanisms 102 may be initiated by controller 118.

In block 1006, an additional drive mechanism 102 or additional drive mechanisms 102 are initiated to move the at least one panel farther along main track 108. The additional drive mechanism or mechanisms 102 can be initiated by controller 118 starting the motors 126 or may be initiated by an automatic starter based on movement from the feeding of a panel from an adjacent drive mechanism 102.

In block 1008, a track guide such as track guide 116 in FIG. 1 can be actuated or switched by controller 118 so as to change from directing movement of the panels along main track 108 to directing movement of the panels along an auxiliary track 114. In this way, it is ordinarily possible to provide for different configurations of the panels to form different partitions defining spaces such as room 204 or 206 as shown in FIG. 1. In other embodiments, block 1008 may be omitted such that the panels are driven along main track 108 without directing the panels onto an auxiliary track 114.

In block 1010, one or more drive mechanisms 102 stop after encountering a resistance to movement of the at least one panel or based on an indication of a location for the at least one panel received from a sensor 119. In other embodiments, controller 118 may stop drive mechanisms 102 based on an input from an operator of controller 118 or based on a timing sequence for moving the at least one panel into place. The wall partition movement process of FIG. 10 then ends.

After reaching their final locations for forming a wall partition, the panels in block 1010 may be locked into place by an operator moving a lever to join adjacent panels or lock the panels into a building floor. In other implementations, the adjacent panels may be locked into place using an electro-mechanical mechanism controlled by controller 118. The locking may also engage a seal along the top, bottom, or side of one or more panels to reduce sound from traveling from one side of the assembled wall partition to the other side.

The foregoing description of the disclosed example embodiments is provided to enable any person of ordinary skill in the art to make or use the embodiments in the present disclosure. Various modifications to these examples will be readily apparent to those of ordinary skill in the art, and the principles disclosed herein may be applied to other examples without departing from the spirit or scope of the present disclosure. The described embodiments are to be considered in all respects only as illustrative and not restrictive and the scope of the disclosure is, therefore, indicated by the following claims rather than by the foregoing description. All changes which come within the meaning and range of equivalency of the claims are to be embraced within their scope.

Those of ordinary skill in the art will appreciate that the various illustrative logical blocks, modules, and processes described in connection with the examples disclosed herein may be implemented as electronic hardware, computer software, or combinations of both. Furthermore, the foregoing processes can be embodied on a computer readable medium which causes a processor, controller, or computer to perform or execute certain functions.

To clearly illustrate this interchangeability of hardware and software, various illustrative components, blocks, and modules have been described above generally in terms of their functionality. Whether such functionality is implemented as hardware or software depends upon the particular application and design constraints imposed on the overall system. Those of ordinary skill in the art may implement the described functionality in varying ways for each particular application, but such implementation decisions should not be interpreted as causing a departure from the scope of the present disclosure.

The various illustrative logical blocks, units, modules, and controllers described in connection with the examples disclosed herein may be implemented or performed with a general purpose processor, a Digital Signal processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The activities of a method or process described in connection with the examples disclosed herein may be embodied directly in hardware, in a software module executed by a processor, or in a combination of the two. The steps of the method or algorithm may also be performed in an alternate order from those provided in the examples. A software module may reside in RAM memory, flash memory, ROM memory, EPROM memory, EEPROM memory, registers, hard disk, a removable media, an optical media, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC.

The foregoing description of the disclosed example embodiments is provided to enable any person of ordinary skill in the art to make or use the embodiments in the present disclosure. Various modifications to these examples will be readily apparent to those of ordinary skill in the art, and the principles disclosed herein may be applied to other examples without departing from the spirit or scope of the present disclosure. The described embodiments are to be considered in all respects only as illustrative and not restrictive and the scope of the disclosure is, therefore, indicated by the following claims rather than by the foregoing description. All changes which come within the meaning and range of equivalency of the claims are to be embraced within their scope.

What is claimed is:

1. A wall partition movement system, comprising:

at least one panel including a trolley and a strip along a width of a vertical surface of the at least one panel for driving the at least one panel;

a main track configured to engage the trolley of the at least one panel to allow the at least one panel to move along the main track; and a plurality of drive mechanisms adjacent the main track and configured to drive the at least one panel from a first drive mechanism of the plurality of drive mechanisms to a second drive mechanism of the plurality of drive mechanisms using the strip of the at least one panel, wherein the first drive mechanism and the second drive mechanism each include at least one contact wheel configured to contact the strip along the width of the vertical surface of the at least one panel to drive the at least one panel, and the first and second drive mechanisms further include at least one motor configured to drive each contact wheel;

wherein the first drive mechanism and the second drive mechanism are spaced from each other along a moving direction of the main track.

2. The wall partition movement system of claim 1, wherein the contact wheels of the first drive mechanism and the second drive mechanism include a deformable material configured to compress against the strip.

3. The wall partition movement system of claim 1, wherein the strip includes teeth configured to engage with contact wheels of the plurality of drive mechanisms.

4. The wall partition movement system of claim 1, wherein the strip includes a friction strip configured to contact contact wheels of the plurality of drive mechanisms.

5. The wall partition movement system of claim 1, wherein the strip includes a deformable material.

6. The wall partition movement system of claim 1, wherein each drive mechanism of the plurality of drive mechanisms includes a plurality of contact wheels for contacting the strip to drive the at least one panel.

7. The wall partition movement system of claim 1, wherein a drive mechanism of the plurality of drive mechanisms is configured to stop driving the at least one panel after encountering a resistance to movement of the at least one panel along the main track at the drive mechanism of the plurality of drive mechanisms.

8. The wall partition movement system of claim 1, wherein a drive mechanism of the plurality of drive mechanisms is configured to start driving the at least one panel in response to movement of the at least one panel along the main track.

9. The wall partition movement system of claim 1, further comprising an auxiliary track positioned at an angle to the main track, wherein the trolley includes at least one flange to direct movement of the at least one panel from the main track to the auxiliary track.

10. The wall partition movement system of claim 1, further comprising:

an auxiliary track positioned at an angle to the main track; and a third drive mechanism adjacent the auxiliary track and positioned to drive the at least one panel toward or away from the main track.

11. The wall partition movement system of claim 1, further comprising:

a controller configured to control operation of the plurality of drive mechanisms; and at least one sensor electrically connected to the controller and positioned along a path of travel of the at least one panel, wherein the at least one sensor is configured to provide to the controller an indication of a location of the at least one panel.

12. A method of moving a wall partition, the method comprising:

feeding at least one panel including a trolley to a first drive mechanism of a plurality of drive mechanisms adjacent a main track configured to engage the trolley of the at least one panel; and initiating the first drive mechanism of the plurality of drive mechanisms to drive the at least one panel to a second drive mechanism of the plurality of drive mechanisms to move the at least one panel farther along the main track, wherein initiating the first drive mechanism includes driving a first contact wheel of the first drive mechanism that contacts a strip along a width of a vertical surface of the at least one panel to drive the at least one panel to a second contact wheel of the second drive mechanism configured to contact the strip along the width of the vertical surface of the at least one panel for driving the at least one panel; wherein the first drive mechanism and the second drive mechanism each include at least one motor configured to drive the respective contact wheel, and the first drive mechanism and the second drive mechanism are spaced from each other along a moving direction of the main track.

13. The method of claim 12, further comprising initiating the second drive mechanism of the plurality of drive mechanisms to drive the at least one panel to a third drive mechanism of the plurality of drive mechanisms to move the at least one panel farther along the main track.

14. The method of claim 12, further comprising stopping a drive mechanism of the plurality of drive mechanisms after encountering a resistance to movement of a panel of the at least one panel along the main track at the drive mechanism of the plurality of drive mechanisms.

15. The method of claim 12, wherein initiating the first drive mechanism of the plurality of drive mechanisms is in response to movement of the at least one panel along the main track.

16. The method of claim 12, further comprising:

switching a guide from directing movement along the main track to directing movement along an auxiliary track positioned at an angle to the main track; and initiating a third drive mechanism adjacent the auxiliary track and positioned to drive the at least one panel from the main track to the auxiliary track.

17. The method of claim 12, further comprising receiving an indication of a location of the at least one panel from a sensor positioned along a path of travel for the at least one panel.

18. A panel for a wall partition, the panel including:

a trolley configured to engage a main track to allow movement of the panel along the main track; and a strip along a width of a vertical surface of the panel configured to contact at least one contact wheel of a plurality of drive mechanisms adjacent the main track so that the panel is driven along the main track from a first drive mechanism of the plurality of drive mechanisms to a second drive mechanism of the plurality of drive mechanisms, wherein the first drive mechanism includes a first contact wheel configured to contact the strip and the second drive mechanism includes a second contact wheel configured to contact the strip; wherein the first drive mechanism and the second drive mechanism each include at least one motor configured to drive the respective contact wheel, and the first drive mechanism and the second drive mechanism are spaced from each other along a moving direction of the main track.

19. The panel of claim 18, wherein the strip is further configured to compress the first contact wheel when the panel is driven from the first drive mechanism to the second drive mechanism.

20. The panel of claim 18, wherein the strip includes teeth configured to engage with the first contact wheel wheel when the panel is driven from the first drive mechanism to the second drive mechanism.

21. The panel of claim 18, wherein the strip includes a friction strip configured to contact the first contact wheel when the panel is driven from the first drive mechanism to the second drive mechanism.

22. The panel of claim 18, wherein the strip includes a deformable material configured to compress against the first contact wheel when the panel is driven from the first drive mechanism to the second drive mechanism.

23. The panel of claim 18, wherein the trolley includes at least one flange configured to direct movement of the panel from the main track to an auxiliary track positioned at an angle to the main track.

* * * * *